US011376625B2

(12) United States Patent
Bahng

(10) Patent No.: US 11,376,625 B2
(45) Date of Patent: Jul. 5, 2022

(54) ROSIN SPREADER

(71) Applicant: Sang Wook Peter Bahng, Fort Lee, NJ (US)

(72) Inventor: Sang Wook Peter Bahng, Fort Lee, NJ (US)

( * ) Notice: Subject to any disclaimer, the term of this patent is extended or adjusted under 35 U.S.C. 154(b) by 52 days.

(21) Appl. No.: 17/064,715

(22) Filed: Oct. 7, 2020

(65) Prior Publication Data

US 2022/0105537 A1 Apr. 7, 2022

(51) Int. Cl.
*B05C 17/10* (2006.01)
*G10D 3/16* (2020.01)

(52) U.S. Cl.
CPC ..... *B05C 17/10* (2013.01); *G10D 3/16* (2013.01)

(58) Field of Classification Search
USPC ..... 118/76, 109, 264, 78, 79; 15/159.1, 166, 15/167.1–167.3, 186–188
See application file for complete search history.

(56) References Cited

U.S. PATENT DOCUMENTS

| | | | | |
|---|---|---|---|---|
| 5,655,482 | A | 8/1997 | Lundquist | |
| 8,230,544 | B2 | 7/2012 | Leshko | |
| 8,595,887 | B2 | 12/2013 | Hiltmann | |
| 2018/0206626 | A1 * | 7/2018 | Binnington ..... | A46B 5/0029 |

FOREIGN PATENT DOCUMENTS

CN 211125003 U * 7/2020

OTHER PUBLICATIONS

English Translation CN211125003U (Year: 2020).*

* cited by examiner

*Primary Examiner* — Yewebdar T Tadesse
(74) *Attorney, Agent, or Firm* — JIKIM LLC—Attorneys at Law; Jisang Kim, Esq

(57) ABSTRACT

The present invention is a rosin spreader that includes a body, a plurality of substantially parallel, spaced apart, elongated first teeth, a plurality of bristles, and an elongated first sidewall. The body has a top surface, a bottom surface, and a peripheral edge. The first teeth extend outwardly from the top surface of the body. The bristles extend outwardly from the top surface of the body. The first sidewall extends upwardly from the top surface of the body. The first teeth, the bristles, and the first sidewall are secured to the top surface of the body.

13 Claims, 6 Drawing Sheets

ROSIN SPREADER

TECHNICAL FIELD & BACKGROUND

The present invention relates to a rosin spreader especially adapted for the bow hair of stringed instruments such as violin, viola and cello. Excessive rosin powder on the bow hair can reduce the performance of the bow. Toothbrushes have been used to wipe off rosin dust on the bow hair. However, such toothbrushes can wipe off only minor clumps of rosin powder and are not effective to evenly distribute rosin particles on the bow hair. Such toothbrushes can even damage the bow hair. In fact, no particular rosin spreaders designed exclusively for the bow hair of stringed instruments have been available.

Therefore, it would be desirable to provide a rosin spreader that not only easily wipes off excessive rosin, but also evenly distributes rosin particles on the bow hair.

SUMMARY OF THE INVENTION

The present invention is directed to a rosin spreader that overcomes the above-mentioned disadvantages of the prior art.

In one aspect, the present invention provides a rosin spreader having a body, a plurality of substantially parallel, spaced apart, elongated first teeth, a plurality of substantially parallel, spaced apart, elongated second teeth, a plurality of bristles, an elongated first sidewall, and an elongated second sidewall. The body has a top surface, a bottom surface, and a peripheral edge. The first teeth extend outwardly from the top surface of the body. The second teeth extend outwardly from the top surface of the body. The first teeth and the second teeth are secured to the top surface of the body. The first teeth and the second teeth are in spaced parallel relationship. The bristles extend outwardly from the top surface of the body. The bristles are positioned between the first teeth and the second teeth. The bristles are secured to the top surface of the body. The first sidewall extends upwardly from the top surface of the body. The second sidewall extends upwardly from the top surface of the body. The first sidewall and the second sidewall are secured to the top surface of the body. The first sidewall and the second sidewall are in spaced parallel relationship. The first teeth, the second teeth, and the bristles are positioned between the first sidewall and the second sidewall.

In another aspect, the present invention provides a rosin spreader having a body, a plurality of substantially parallel, spaced apart, elongated first teeth, a plurality of bristles, and an elongated first sidewall. The body has a top surface, a bottom surface, and a peripheral edge. The first teeth extend outwardly from the top surface of the body. The bristles extend outwardly from the top surface of the body. The first sidewall extends upwardly from the top surface of the body. The first teeth, the bristles, and the first sidewall are secured to the top surface of the body.

In a further aspect, the present invention provides a rosin spreader having a body, a plurality of substantially parallel, spaced apart, elongated first teeth, a plurality of substantially parallel, spaced apart, elongated second teeth, a plurality of bristles, an elongated first sidewall, and an elongated second sidewall. The body has a top surface, a bottom surface, a front and a peripheral edge. The first teeth extend outwardly from the top surface of the body. The first teeth extend in directions substantially 90° from the top surface of the body. The second teeth extend outwardly from the top surface of the body. The second teeth have an identical material, thickness and/or extent in the longitudinal direction of the first teeth. The first teeth and the second teeth are secured to the top surface of the body. The first teeth and the second teeth are in spaced parallel relationship. The bristles extend outwardly from the top surface of the body. The bristles are positioned between the first teeth and the second teeth. The bristles are secured to the top surface of the body. The first sidewall extends upwardly from the top surface of the body. The first sidewall is adjacent to the front of the body. The second sidewall extends upwardly from the top surface of the body. The first sidewall and the second sidewall are secured to the top surface of the body. The first sidewall and the second sidewall are in spaced parallel relationship. The first teeth, the second teeth, and the bristles are positioned between the first sidewall and the second sidewall.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments. Various operations will be described as multiple discrete operations, in turn, in a manner that is most helpful in understanding the present invention. However, the order of description should not be construed as to imply that these operations are necessarily order dependent. In particular, these operations need not be performed in the order of presentation. The phrase "in one embodiment" is used repeatedly. The phrase generally does not refer to the same embodiment, however, it may. The terms "comprising", "having" and "including" are synonymous, unless the context dictates otherwise.

This present invention provides a rosin spreader that could dramatically improve the performance of the bow, not only by wiping off such excessive rosin on the bow hair, but also by evenly distributing rosin particles on the hair.

Figure 1:
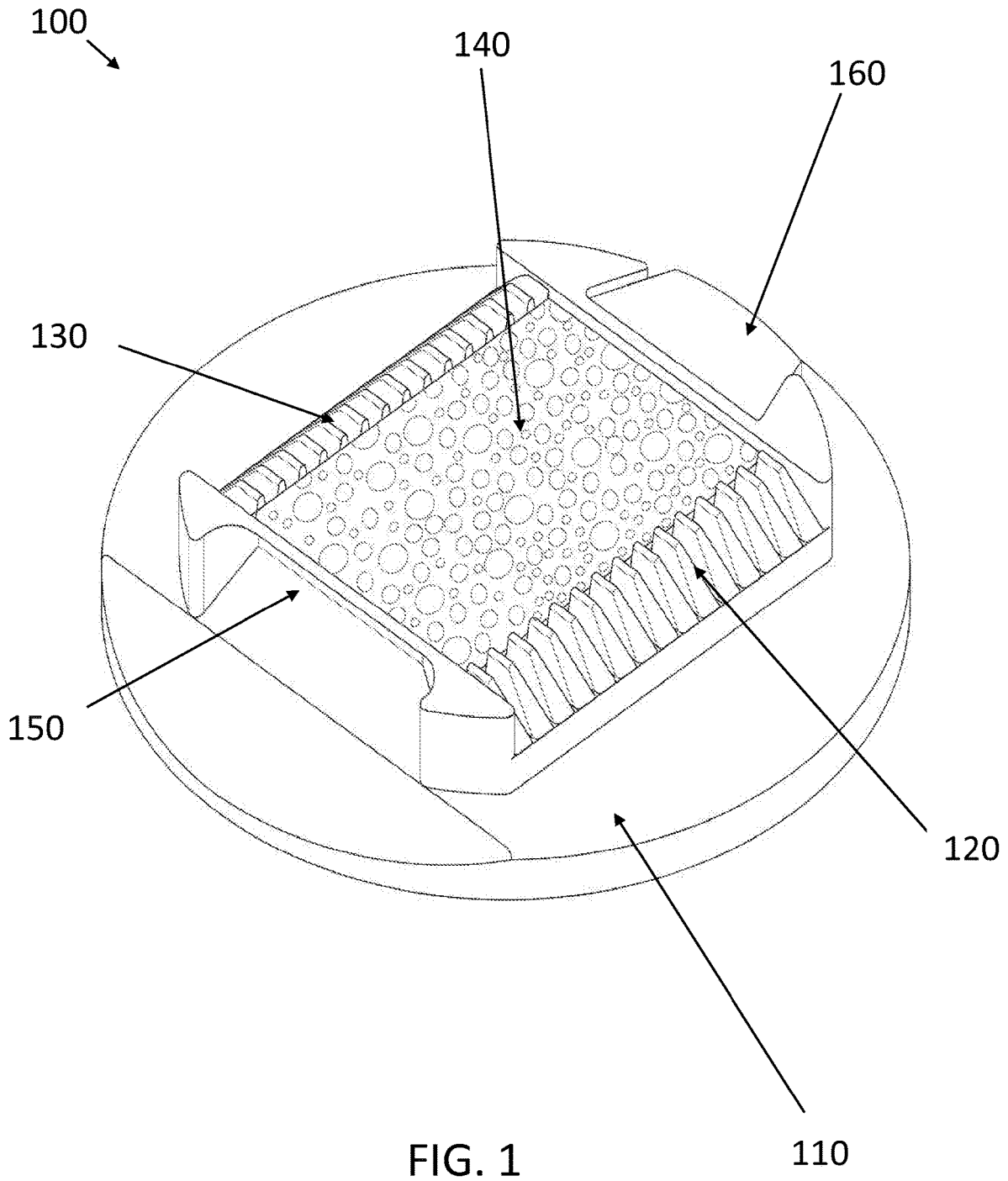
FIG. 1 illustrates a perspective view of a rosin spreader, in accordance with one embodiment of the present invention.

FIG. 1 illustrates a perspective view of a rosin spreader 100, in accordance with one embodiment of the present invention.

Referring to FIG. 1, a rosin spreader 100 includes a body 110, a plurality of substantially parallel, spaced apart, elongated first teeth 120, a plurality of substantially parallel, spaced apart, elongated second teeth 130, a plurality of bristles 140, an elongated first sidewall 150, and an elongated second sidewall 160.

Figure 2:
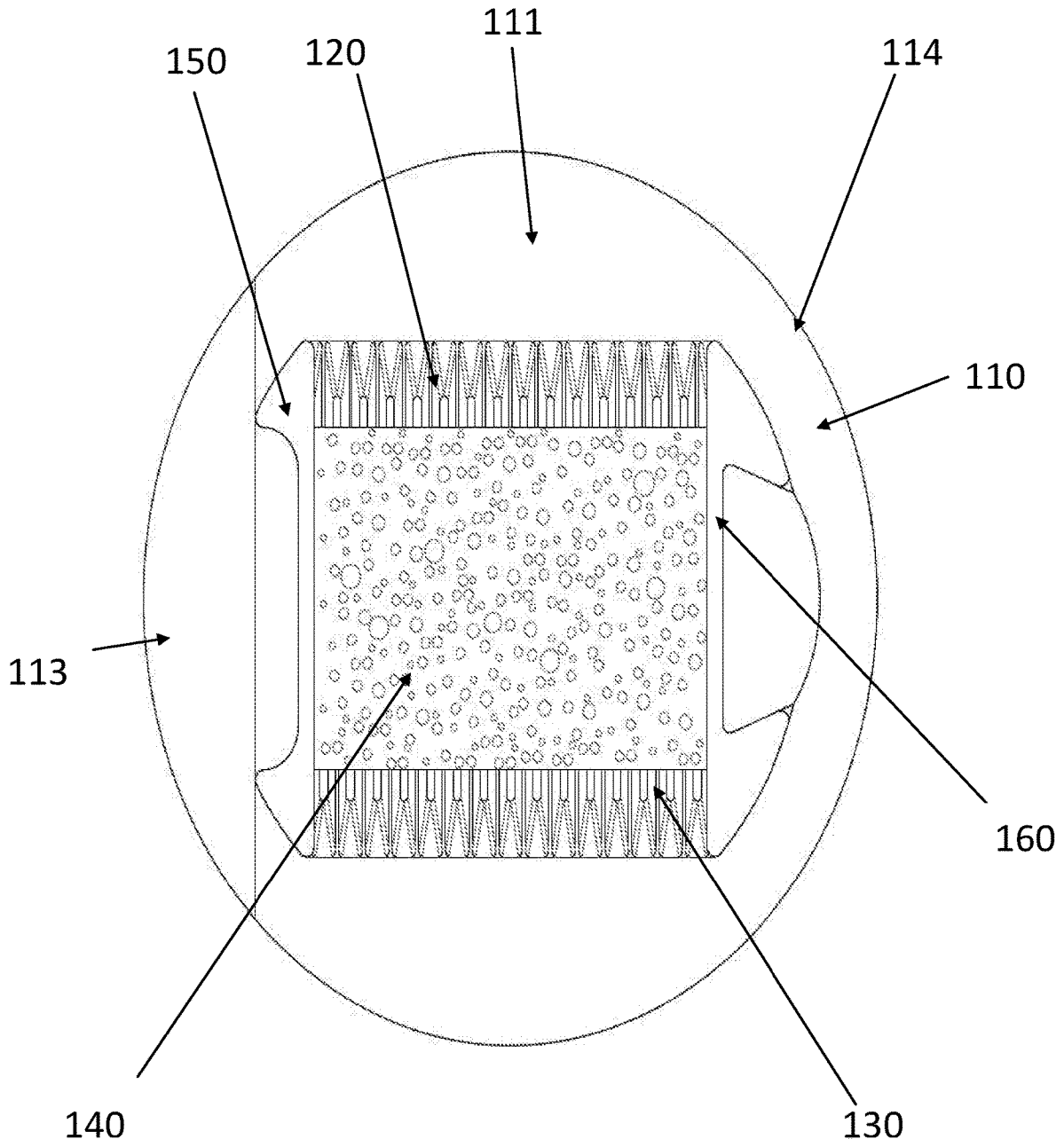
FIG. 2 illustrates a top view of a rosin spreader, in accordance with one embodiment of the present invention.
Figure 3:
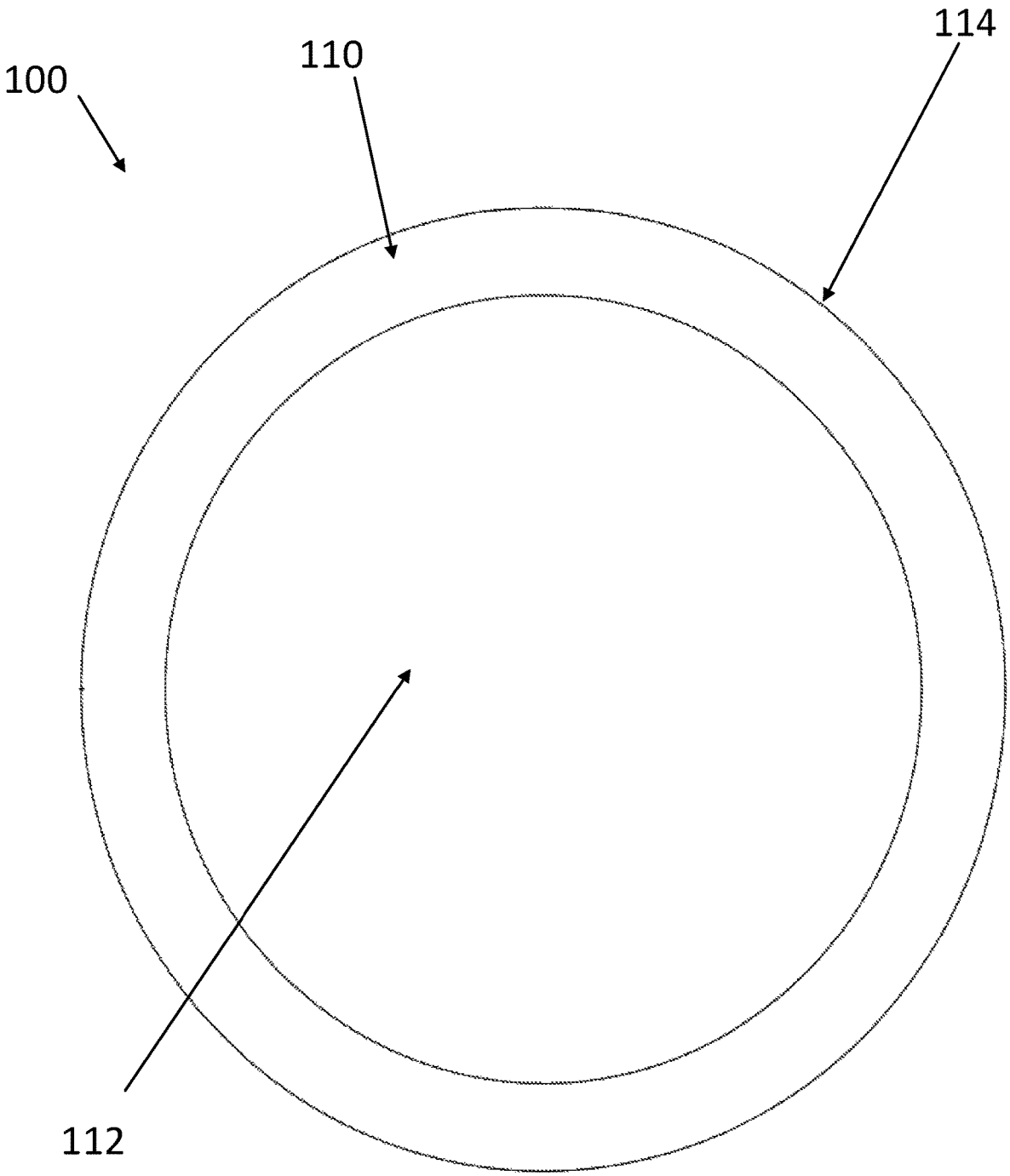
FIG. 3 illustrates a bottom view of a rosin spreader, in accordance with one embodiment of the present invention.

FIG. 2 illustrates a top view of a rosin spreader 100, in accordance with one embodiment of the present invention. FIG. 3 illustrates a bottom view of a rosin spreader 100, in accordance with one embodiment of the present invention.

In an exemplary embodiment, and as illustrated in FIGS. 1, 2, and 3, the body 110 has a top surface 111, a bottom surface 112, a front 113 and a peripheral edge 114. The body 110 may be comprised of a metal, plastic, or other suitable flexible, semi-rigid material. Preferably, the body 110 may comprise one or more materials selected from the group consisting of: wood, metal, plastic, and rubber. The body 110 may further comprise material suitable for graphic decoration. The body 110 may provide a convenient surface to graphically decorate such as drawings or text. A logo may be inscribed on the bottom surface 112 of the body 110. The body 110 may further comprise at least one of a waterproof material and a water resistant material.

Figure 4:
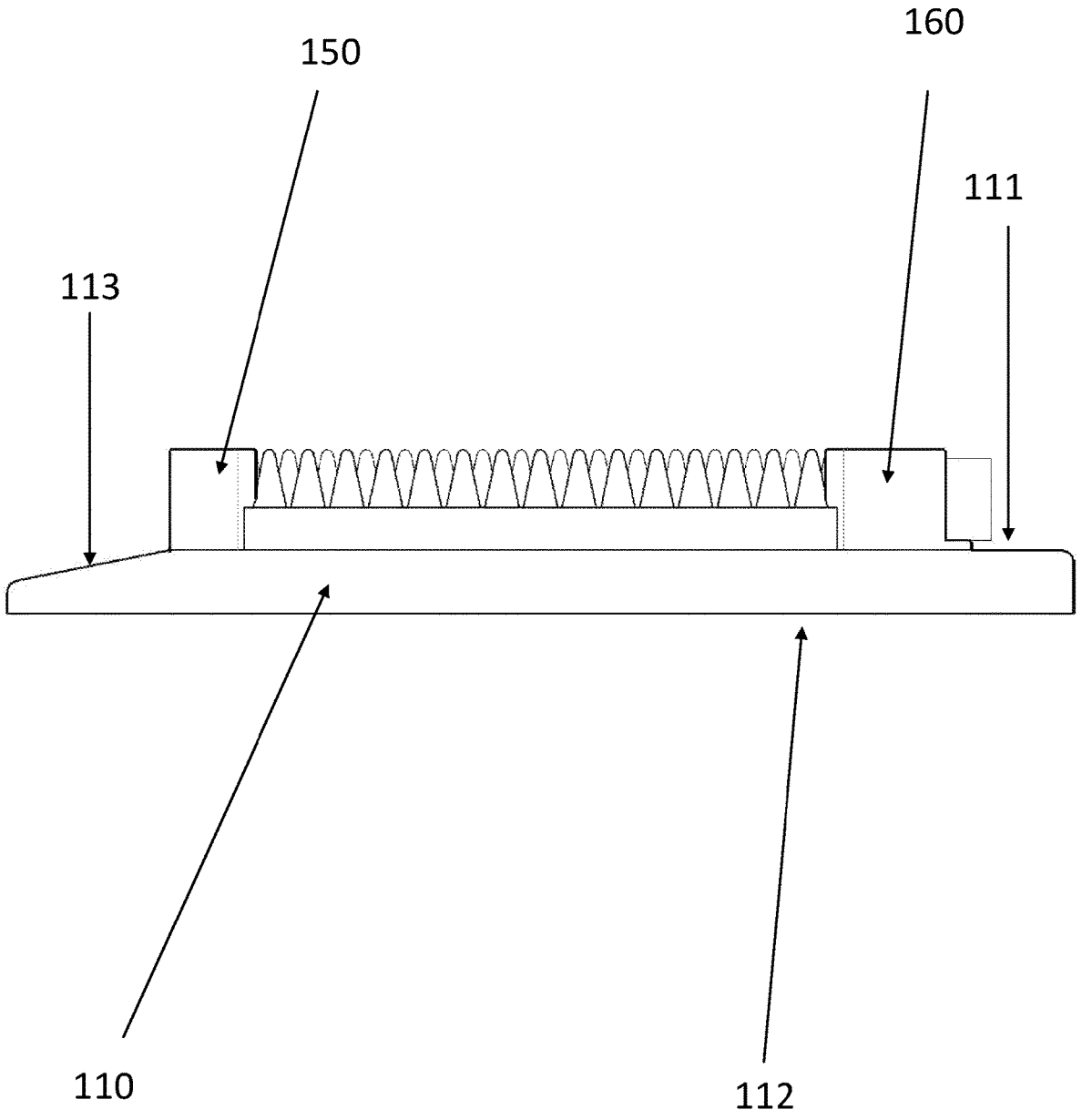
FIG. 4 illustrates a side view of a rosin spreader, in accordance with one embodiment of the present invention.

FIG. 4 illustrates a side view of a rosin spreader 100, in accordance with one embodiment of the present invention.

Referring to FIGS. 1, 2, and 4, the first teeth 120 extend outwardly from the top surface 111 of the body 110. The first teeth 120 extend in directions substantially 90° from the top surface 111 of the body 110. The second teeth 130 extend outwardly from the top surface 111 of the body 110. The second teeth 130 have an identical material, thickness and/or extent in the longitudinal direction of the first teeth 120. The first teeth 120 and the second teeth 130 are secured to the top surface 111 of the body 110. The first teeth 120 and the second teeth 130 are in spaced parallel relationship.

Preferably, the first teeth 120 and the second teeth 130 may comprise one or more materials selected from the group consisting of: wood, metal, and plastic. The first teeth 120 and the second teeth 130 may be further comprised of a metal, plastic, or other suitable flexible, semi-rigid material. The first teeth 120 and the second teeth 130 can be attached to the top surface 111 of the body 110 in a variety of ways, including heat welding and adhesives. However, the first teeth 120 and the second teeth 130 are preferably affixed to the top surface 111 via a heat welding that securely holds the first teeth 120 and the second teeth 130 in position. Thus, the first teeth 120 and the second teeth 130 remain securely attached to the top surface 111 of the body 110 when the first teeth 120 and the second teeth 130 are in use.

Referring to FIGS. 1 and 2, the bristles 140 extend outwardly from the top surface 111 of the body 110. The bristles 140 are positioned between the first teeth 120 and the second teeth 130. The bristles 140 are secured to the top surface 111 of the body 110. Preferably, the bristles 140 may comprise one or more materials selected from the group consisting of: microfiber, synthetic fiber, polypropylene, polyethylene, rayon, polyester, and polyurethane. The bristles 140 may be secured by heat welding or adhesives to the top surface 111 of the body 110.

Figure 5:
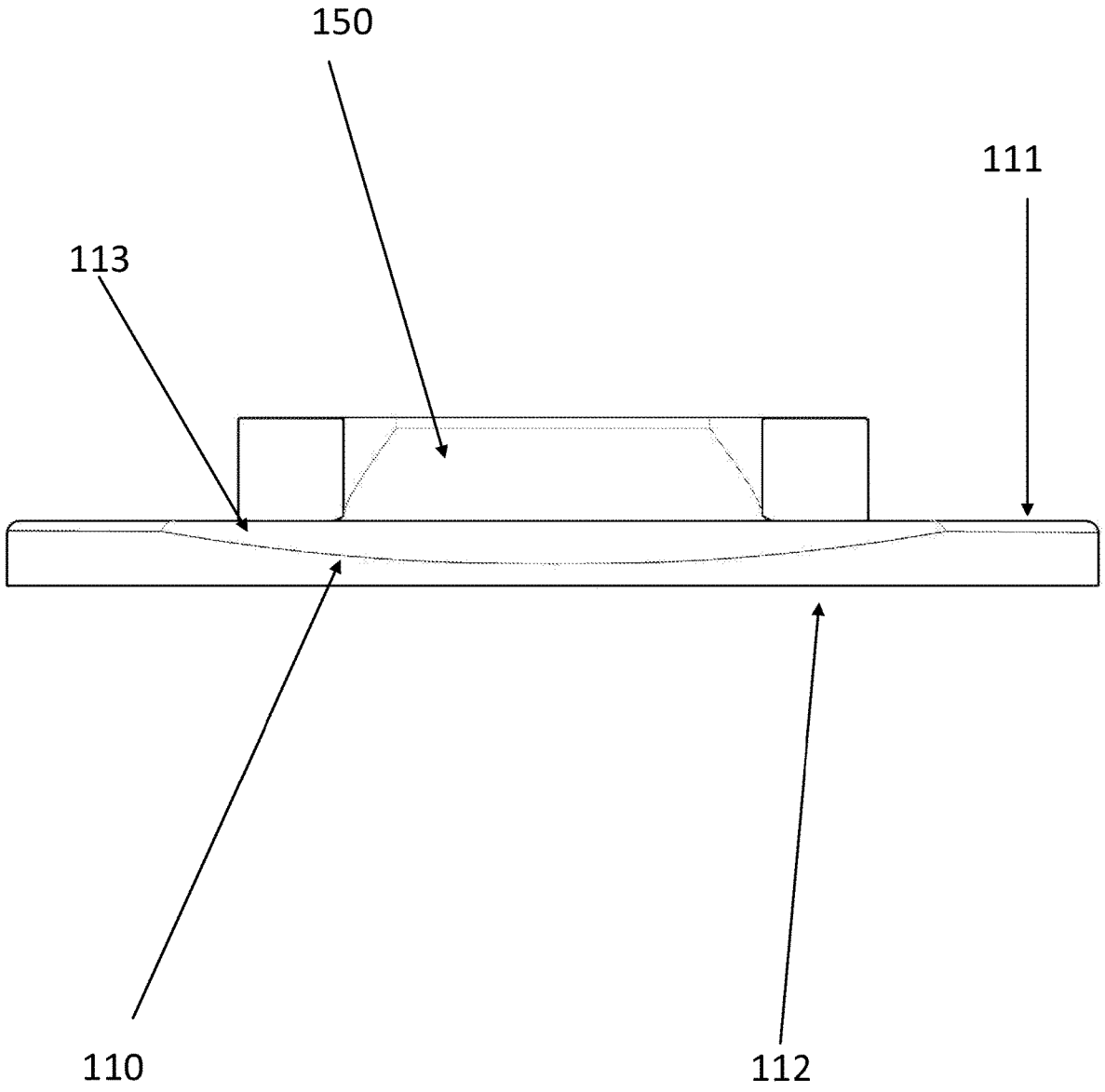
FIG. 5 illustrates a front view of a rosin spreader, in accordance with one embodiment of the present invention.
Figure 6:
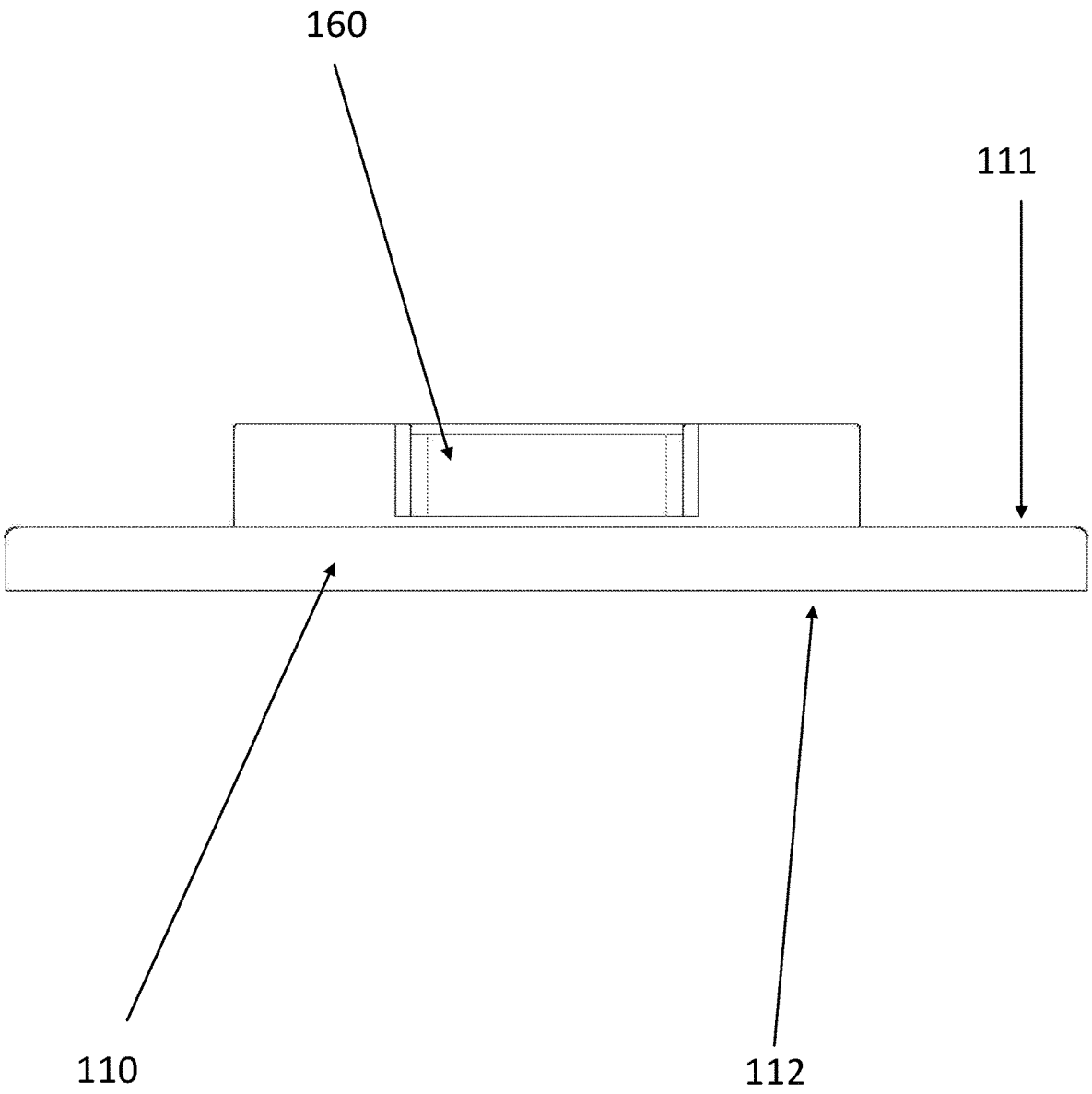
FIG. 6 illustrates a back view of a rosin spreader, in accordance with one embodiment of the present invention.

FIG. 5 illustrates a front view of a rosin spreader 100, in accordance with one embodiment of the present invention. FIG. 6 illustrates a back view of a rosin spreader 100, in accordance with one embodiment of the present invention.

In an exemplary embodiment, and as illustrated in FIGS. 1, 5 and 6, the first sidewall 150 extends upwardly from the top surface 111 of the body 110. The first sidewall 150 is adjacent to the front 113 of the body 110. The second sidewall 160 extends upwardly from the top surface 111 of the body 110. The first sidewall 150 and the second sidewall 160 are secured to the top surface 111 of the body 110. The first sidewall 150 and the second sidewall 160 are in spaced parallel relationship.

Preferably, the first sidewall 150 and the second sidewall 160 may comprise one or more materials selected from the group consisting of: wood, metal, plastic, and rubber. The first sidewall 150 and the second sidewall 160 may be formed from a semi-rigid or flexible material. The first sidewall 150 and the second sidewall 160 may be secured by heat welding or adhesives to the top surface 111 of the body 110.

Referring to FIG. 1, the first teeth 120, the second teeth 130, and the bristles 140 are positioned between the first sidewall 150 and the second sidewall 160.

Thus, the present invention disclosed herein provides an improved rosin spreader that not only wipes off excessive rosin, but also evenly distributes rosin particles on the bow hair by implementing such teeth and bristles. While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A rosin spreader, comprising:

a body having a top surface, a bottom surface, and a peripheral edge;

a plurality of substantially parallel, spaced apart, elongated first teeth extending outwardly from the top surface of the body;

a plurality of substantially parallel, spaced apart, elongated second teeth extending outwardly from the top surface of the body;

wherein the first teeth and the second teeth are secured to the top surface of the body, the first teeth and the second teeth being in spaced parallel relationship;

a plurality of bristles extending outwardly from the top surface of the body, the bristles being positioned between the first teeth and the second teeth, the bristles being secured to the top surface of the body;

an elongated first sidewall extending upwardly from the top surface of the body;

an elongated second sidewall extending upwardly from the top surface of the body;

wherein the first sidewall and the second sidewall are secured to the top surface of the body, the first sidewall and the second sidewall being in spaced parallel relationship;

and wherein the first teeth, the second teeth, and the bristles are positioned between the first sidewall and the second sidewall.

2. The rosin spreader according to claim 1, wherein the body comprises one or more materials selected from the group consisting of: wood, metal, plastic, and rubber.

3. The rosin spreader according to claim 1, wherein the bristles comprise one or more materials selected from the group consisting of: microfiber, synthetic fiber, polypropylene, polyethylene, rayon, polyester, and polyurethane.

4. The rosin spreader according to claim 1, wherein the body comprises material suitable for graphic decoration.

5. The rosin spreader according to claim 1, wherein the body comprises at least one of a waterproof material and a water resistant material.

6. The rosin spreader according to claim 1, wherein the first teeth and the second teeth comprise one or more materials selected from the group consisting of: wood, metal, and plastic.

7. The rosin spreader according to claim 1, wherein a logo is inscribed on the bottom surface of the body.

8. A rosin spreader, comprising:

a body having a top surface, a bottom surface, a front and a peripheral edge;

a plurality of substantially parallel, spaced apart, elongated first teeth extending outwardly from the top surface of the body;

wherein the first teeth extend in directions substantially 90° from the top surface of the body;

a plurality of substantially parallel, spaced apart, elongated second teeth extending outwardly from the top surface of the body;

wherein the second teeth have an identical material, thickness and/or extent in the longitudinal direction of the first teeth;

wherein the first teeth and the second teeth are secured to the top surface of the body, the first teeth and the second teeth being in spaced parallel relationship;

a plurality of bristles extending outwardly from the top surface of the body, the bristles being positioned between the first teeth and the second teeth, the bristles being secured to the top surface of the body;

an elongated first sidewall extending upwardly from the top surface of the body, the first sidewall being adjacent to the front of the body;

an elongated second sidewall extending upwardly from the top surface of the body;

wherein the first sidewall and the second sidewall are secured to the top surface of the body, the first sidewall and the second sidewall being in spaced parallel relationship; and wherein the first teeth, the second teeth, and the bristles are positioned between the first sidewall and the second sidewall.

9. The rosin spreader according to claim 8, wherein the body comprises one or more materials selected from the group consisting of: wood, metal, plastic, and rubber.

10. The rosin spreader according to claim 8, wherein the bristles comprise one or more materials selected from the group consisting of: microfiber, synthetic fiber, polypropylene, polyethylene, rayon, polyester, and polyurethane.

11. The rosin spreader according to claim 8, wherein the body comprises material suitable for graphic decoration.

12. The rosin spreader according to claim 8, wherein the body comprises at least one of a waterproof material and a water resistant material.

13. The rosin spreader according to claim 8, wherein a logo is inscribed on the bottom surface of the body.

* * * * *